US007377077B2

(12) United States Patent
Rebeck

(10) Patent No.: US 7,377,077 B2
(45) Date of Patent: May 27, 2008

(54) GRILLE SHELTER

(76) Inventor: Robert G. Rebeck, 2320 Doty Rd. P.O. Box 17, Osseo, MI (US) 49226

( * ) Notice: Subject to any disclaimer, the term of this patent is extended or adjusted under 35 U.S.C. 154(b) by 634 days.

(21) Appl. No.: 10/707,406

(22) Filed: Dec. 11, 2003

(65) Prior Publication Data

US 2005/0126083 A1 Jun. 16, 2005

(51) Int. Cl.
*E04B 7/00* (2006.01)

(52) U.S. Cl. ..... 52/23; 52/79.1; 52/DIG. 14; 52/3

(58) Field of Classification Search ..... 52/36.2, 52/3, DIG. 14, 23, 79.1; 312/208.3, 223.1; D7/334, 402; 150/154, 158, 164, 165
See application file for complete search history.

(56) References Cited

U.S. PATENT DOCUMENTS

| | | | | | |
|---|---|---|---|---|---|
| 131,114 | A | * | 9/1872 | O'Brien | 52/69 |
| 1,889,760 | A | * | 12/1932 | O'Gallagher | 312/240 |
| 2,953,244 | A | * | 9/1960 | Phillips | 312/205 |
| 3,120,076 | A | | 2/1964 | Zuch | |
| 3,655,253 | A | * | 4/1972 | Deeds et al. | 312/194 |
| 3,707,316 | A | * | 12/1972 | Mark | 312/208.3 |
| 4,056,294 | A | * | 11/1977 | Godlewski et al. | 312/30 |
| 4,128,285 | A | * | 12/1978 | Lore et al. | 312/196 |
| 4,253,715 | A | * | 3/1981 | Greiner | 312/21 |
| 4,438,606 | A | | 3/1984 | Chardon et al. | |
| D324,153 | S | | 2/1992 | Wood | |
| 5,245,801 | A | * | 9/1993 | Boesvert | 52/63 |
| D377,136 | S | | 1/1997 | Knuth | |
| 5,737,880 | A | * | 4/1998 | Hayes et al. | 52/79.1 |
| 6,058,658 | A | | 5/2000 | Dunn | |
| 6,070,372 | A | * | 6/2000 | Norman et al. | 52/71 |
| 6,341,451 | B1 | * | 1/2002 | Morton, Sr. | 52/64 |
| D466,752 | S | | 12/2002 | Rowe et al. | |

* cited by examiner

*Primary Examiner*—Richard E. Chilcot, Jr.
*Assistant Examiner*—Chi Q. Nguyen
(74) *Attorney, Agent, or Firm*—Foster, Swift, Collins & Smith, P.C.; Allan O. Maki

(57) ABSTRACT

A grille shelter includes a housing comprising a rear wall, a first side wall and a second side wall. A roof member is pivotally connected to a top edge of the housing and at least one pivoting panel is connected to one of the first side wall and second side wall. The pivoting panels are moveable between a first (open) position, wherein a user can access the grille within the shelter, and a second (closed) position, wherein the shelter conceals a grille contained therein. The roof member is also moveable between a first and second position. The grille shelter is configured to allow use of the grille while the grille remains positioned within the grille shelter and may optionally include a floor platform and other accessories to assist the user.

2 Claims, 7 Drawing Sheets

GRILLE SHELTER

BACKGROUND OF INVENTION

1. Field of the Invention

The present invention generally relates to a grille shelter and particularly to a grille shelter capable of moving from a closed position for use in storing a grille to an open position that allows a user to use the grille for cooking while the grille remains positioned inside the grille shelter.

2. Discussion of Related Art

Barbecue grilles are a popular cooking device used to prepare and cook food outdoors. Typically, they are stored outdoors due to their style and weight, and to make them convenient for use. To reduce the grille's exposure to the weather, many types of covers are available. Some grille covers are made of nylon, canvas or other suitable fabric material. Unfortunately, these types of covers often tear or become damaged after prolonged exposure to the effects of sun, rain or snow. Other types of grille covers are constructed with rigid materials such as plastic or other suitable materials to provide a more robust and weather resistant cover. Although more durable, they tend to be heavy and difficult to lift and place over a grille for storage and to remove from a grille for use.

In addition to the aforementioned shortcomings of grille covers currently available in the art, there are no known covers capable of providing a storage facility for a grille that will also allow for use of the grille while positioned within that storage facility. When a user desires to use the grille for cooking, he or she must either remove the cover from the grille, or remove the grille from its storage location. Often, even when a grille is covered with a grille cover, the user must also move the grille to a suitable location for use in order to accommodate for smoke and heat that is generated when cooking on a grille.

Thus, there is a desire and need in the art to provide a grille cover or storage facility configured to provide for storage and protection of the grille while not in use, and with the ability to allow for use of the grille while it remains located within the grille storage facility.

SUMMARY OF INVENTION

Accordingly, the present invention provides a grille shelter configured to store an outdoor cooking device, such as a barbecue grille, to protect it from the effects of weather and other damaging elements while providing an aesthetically pleasing appearance. The grille shelter of the present invention is also configured to allow for use of the grille to cook food while the grille remains positioned within the grille shelter.

In one embodiment of the present invention, a grille shelter includes a housing comprising a rear wall, a first side wall and a second side wall. A roof member is pivotally connected to a top edge of the housing. At least one pivoting panel is pivotally connected to at least one of the first side walls and is moveable between a first position, wherein a user may access the grille within the shelter, and a second position wherein the shelter conceals a grille contained therein.

In another embodiment of the present invention, a grille shelter includes a rear wall, a first side wall and a second side wall connected to opposing ends of the rear wall. A roof member is pivotally connected to a top edge of the rear wall and at least one pivoting panel is pivotally connected to at least one of the side walls. The roof member is moveable between a first position and a second position. The pivoting panel is moveable between a first position and a second position.

Other features of the present invention will become more apparent to persons having ordinary skill in the art to which the present invention pertains from the following description and claims taken in conjunction with the accompanying figures.

BRIEF DESCRIPTION OF DRAWINGS

The foregoing features, as well as other features, will become apparent with reference to the description and figures below, in which like numerals represent like elements, and in which.

DETAILED DESCRIPTION

Figure 1:
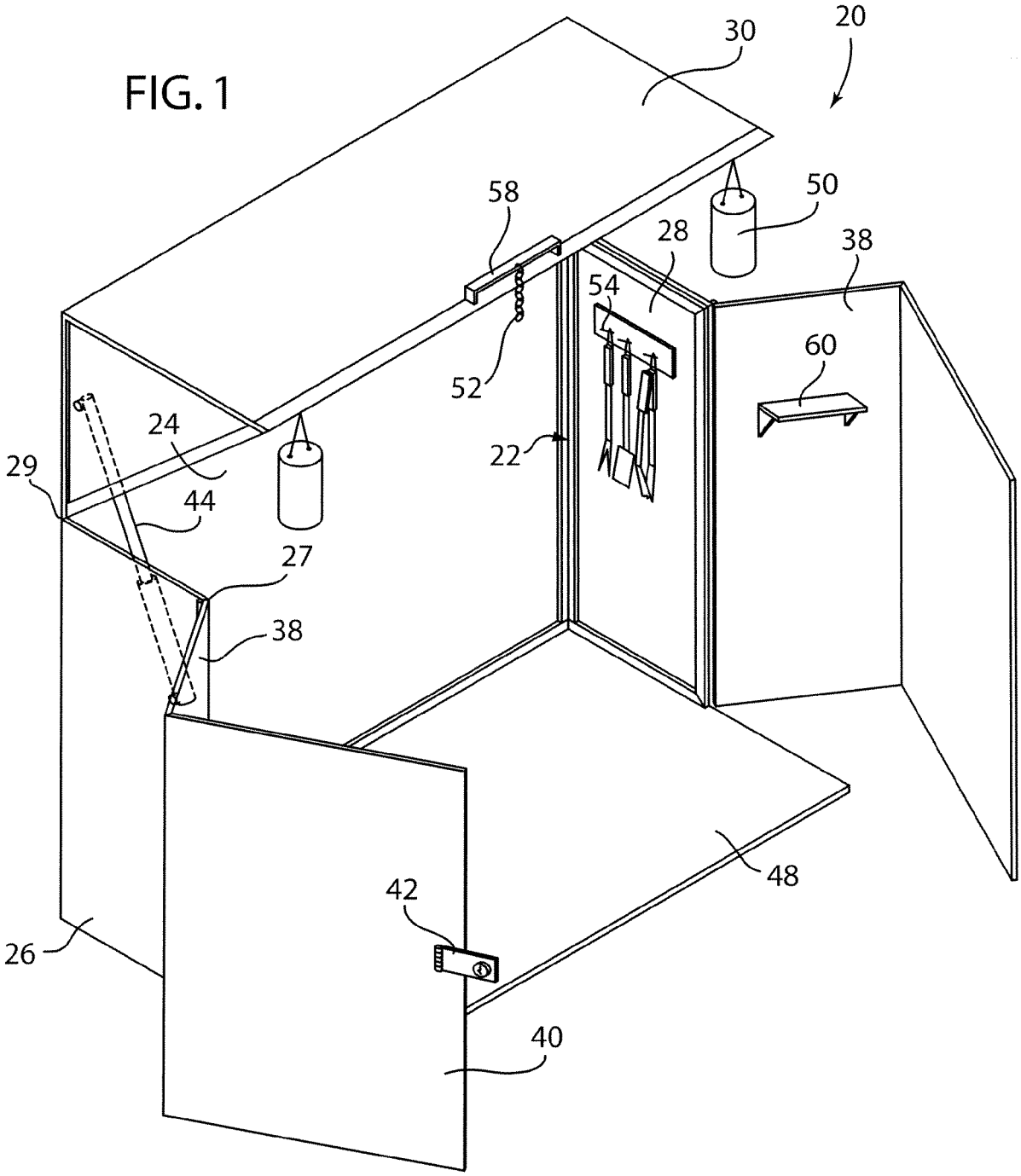
FIG. 1 is a front perspective view of a grille shelter of the present invention in a first position.
Figure 2:
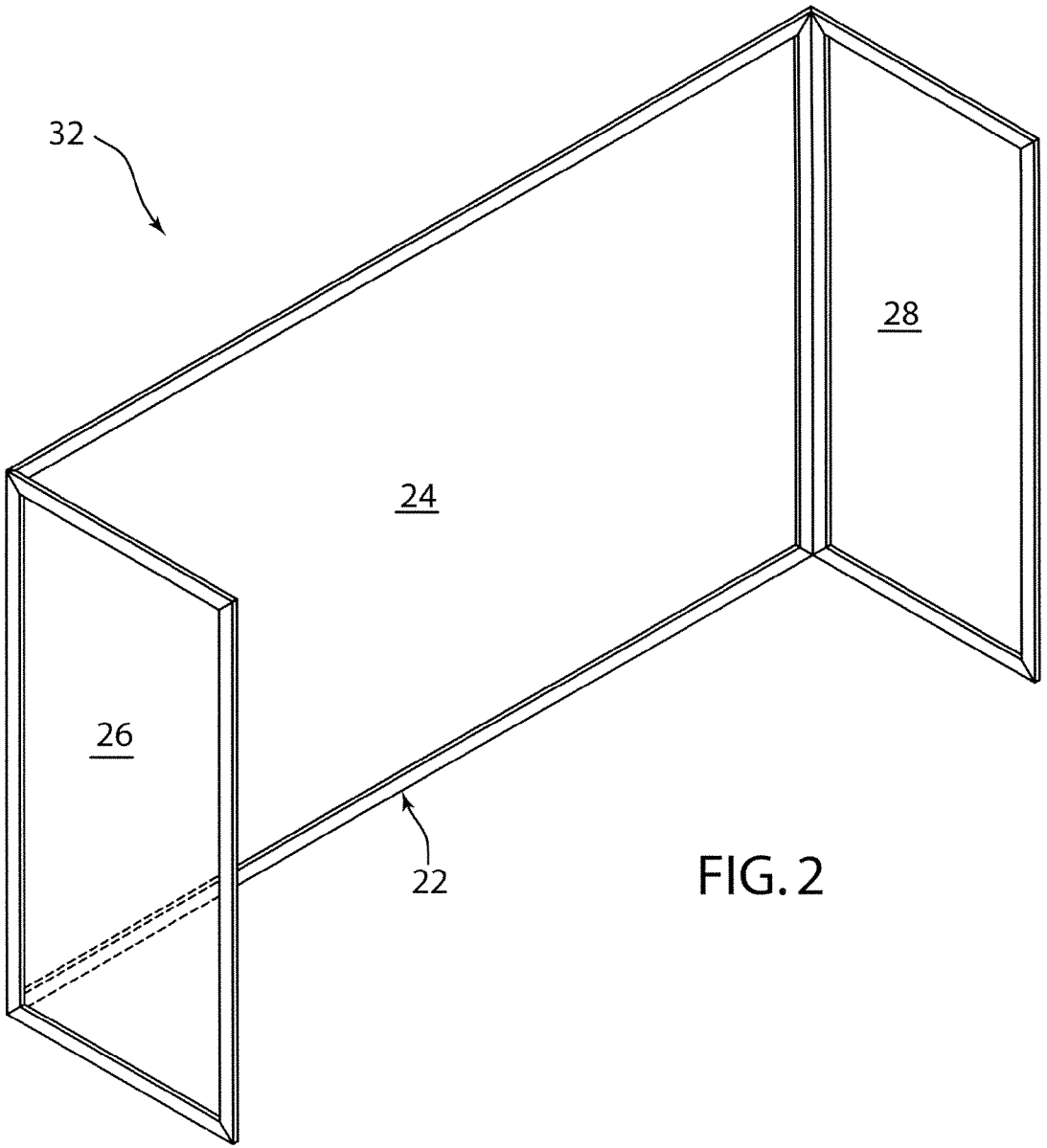
FIG. 2 is a perspective view of a housing of the present invention.

The present invention provides a grille shelter configured to store a barbecue grille to protect it from the effects of weather and other damaging elements and provide an aesthetically pleasing appearance. The grille shelter of the present invention includes one or more moveable panels and a moveable roof, which allow the user to reconfigure the grille shelter between a first (open) and second (closed) position to permit use of the grille to cook food while the grille remains positioned within the grille shelter.

Referring to FIGS. 1-4, in one embodiment of the present invention, a grille shelter 20 may include a frame assembly 22, a rear wall 24, a first side wall 26, and a second side wall 28 forming a housing 32, and a roof member 30. Frame assembly 22 may include a plurality of frame members constructed with conventional materials such as steel, aluminum, fire retardant wood beams or other suitable structural framing materials. Frame assembly 22 may be bolted, nailed, threadably fastened together, or connected by any other suitable attachment method known in the art. Depending on the type of material used to construct the various walls of grille shelter 20, frame assembly 22 may not be necessary. In such a configuration, the walls 24, 26 and 28 of grille shelter 20 may be connected directly to each other and the roof member 30 may be connected directly to one or more of the walls 24, 26 and 28. Alternatively, rear wall 24 and first and second side walls 26 and 28 may be formed as one unit. These alternative embodiments may work best with sheet metal, plastic or other strong light-weight material. Such materials may be provided with a decorative surface layer, for example, wood grain or decorative enamel.

It is also noted that the embodiment of grille shelter 20 illustrated in the figures envisions a grille shelter 20 constructed primarily of wood. It is to be understood, however, that grille shelter 20 may alternatively be constructed of other materials such as masonry, steel or plastic. Other materials may be desired to achieve a specific aesthetic appearance, but will not affect the functional benefits provided by the present invention.

For the illustrated embodiment, rear wall 24 and first and second side walls 26 and 28 may be connected to frame assembly 22 such that first and second side walls 26 and 28 are positioned on opposite ends and adjacent to rear wall 24. As stated, rear wall 24 and first and second side walls 26 and 28 may be constructed of wood or any other suitable material such as plastic or steel. In the embodiment shown in the figures, rear wall 24 and first and second side walls 26 and 28 may be connected to frame assembly 22 utilizing a variety of attachment methods, such as a threaded connection using screws or bolts, nails, straps, pins or any other variety of known attachment means. As shown in the figures, first and second side walls 26 and 28 only extend forwardly to about the middle of the width of the grille shelter.

Figure 4:
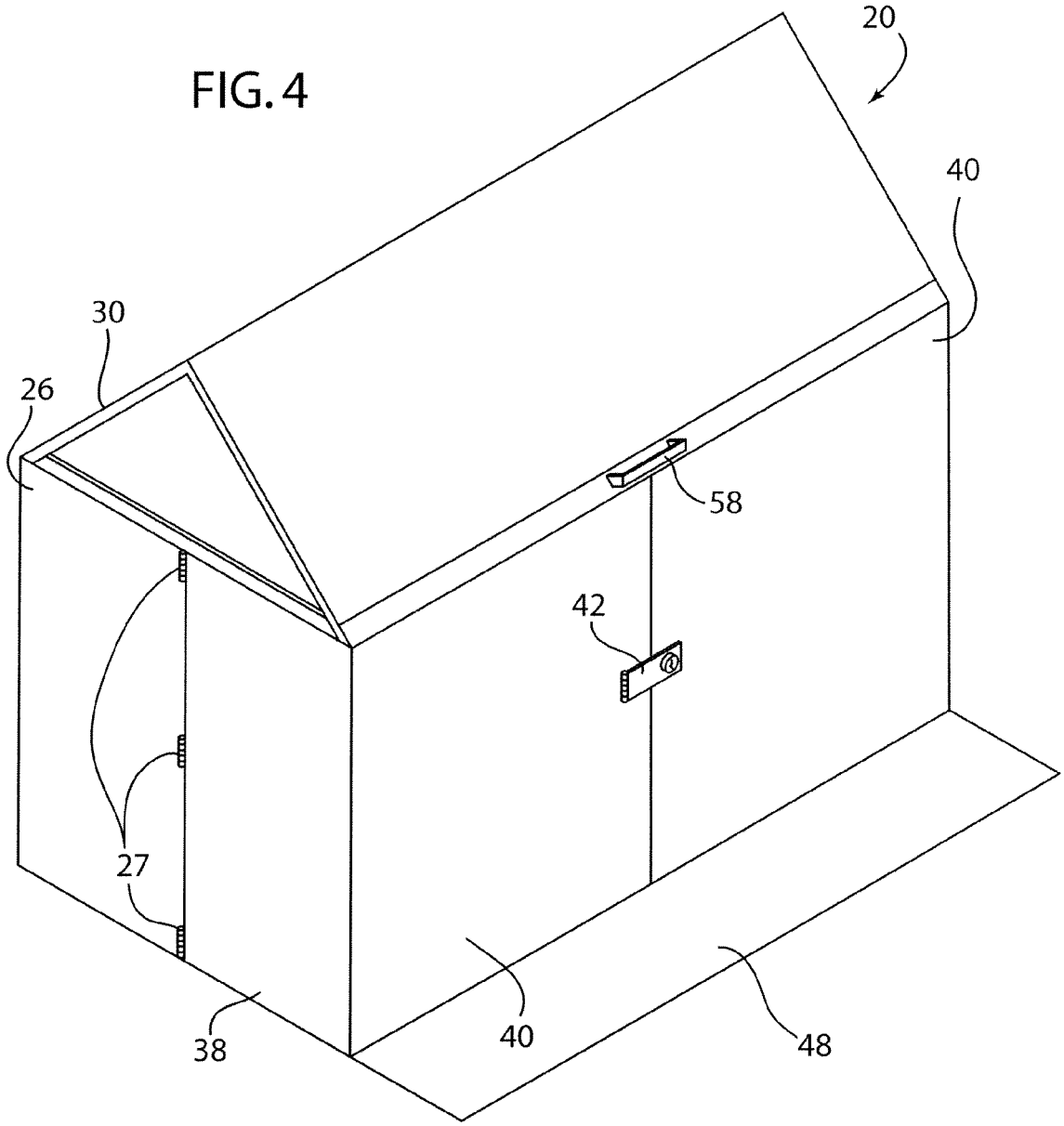
FIG. 4 is a front perspective view of a grille shelter of the present invention in a second position.
Figure 6:
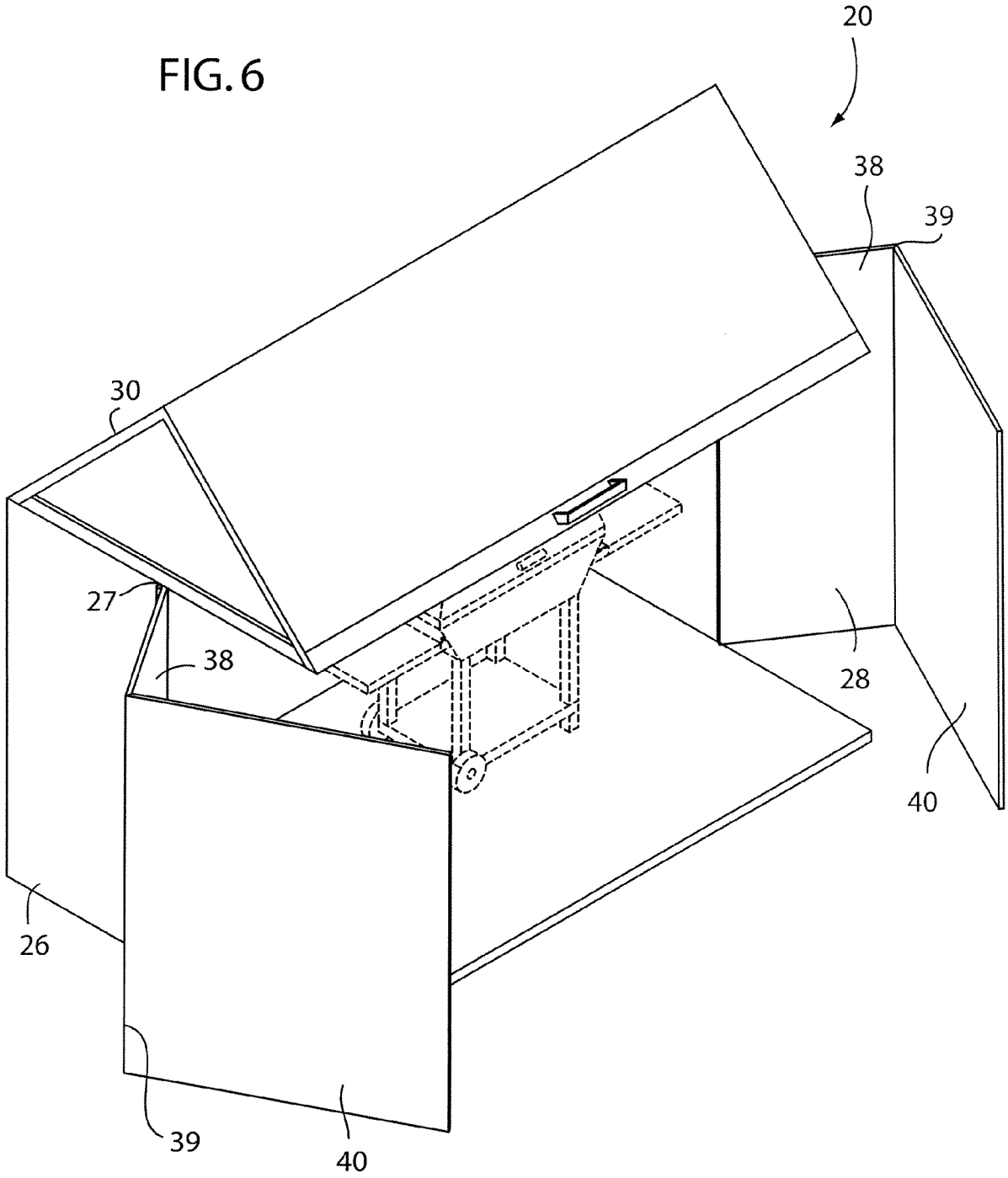
FIG. 6 is a front perspective view of an embodiment of a grille shelter of the present invention.
Figure 7:
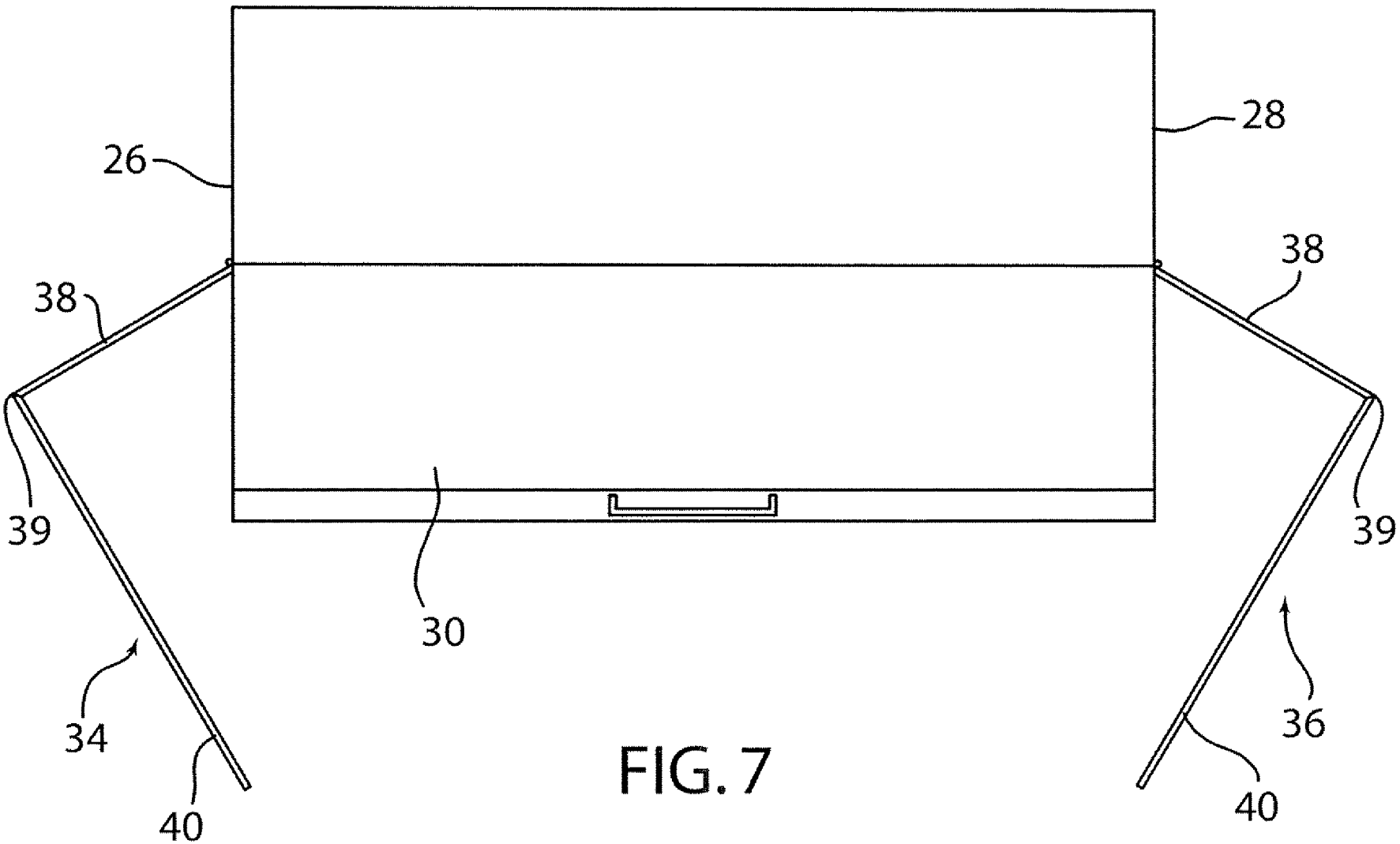
FIG. 7 is a top view of the embodiment shown in FIG. 6.

A first pivoting panel 34 and a second pivoting panel 36 may be pivotally or hingedly attached to first and second side walls 26 and 28 respectively with first hinged attachment 27 as shown in FIG. 1. If a relatively small grille is to be sheltered, a single pivoting panel may suffice. First and second pivoting panels 34 and 36 may include a first section 38 and second section 40 configured to enclose the front corners of grille shelter 20 as shown in FIG. 4. First and second sections 38 and 40 may alternatively be pivotally or hingedly connected at the corners to allow for even more flexibility when opening grille shelter 20 as shown at connection 39 in FIGS. 6 and 7. In an embodiment where the housing 32 is formed with the walls 24, 26 and 28 as a single sheet, panels 34 and 36 may be attached to the forward edges thereof.

First and second panels 34 and 36 allow grille shelter 20 to be repositioned from a first position as shown in FIG. 1, to a second position as shown in FIG. 4. In the second position, first and second pivoting panels 34 and 36 form the front corners of grille shelter 20 and come together at a location in the front of grille shelter 20 as shown in FIG. 4. A latch assembly 42 may be used to securely connect first and second pivoting walls 34 and 36 in the second position. A variety of latch assemblies known and available in the art may be incorporated and used as latch assembly 42. Latch assembly 42 may also be configured to accept a conventional lock to further secure the grille within grille shelter 20. As many grilles available in the art are very expensive, it may be desirable to protect the grille or other items placed within the grille shelter from potential theft.

Figure 3:
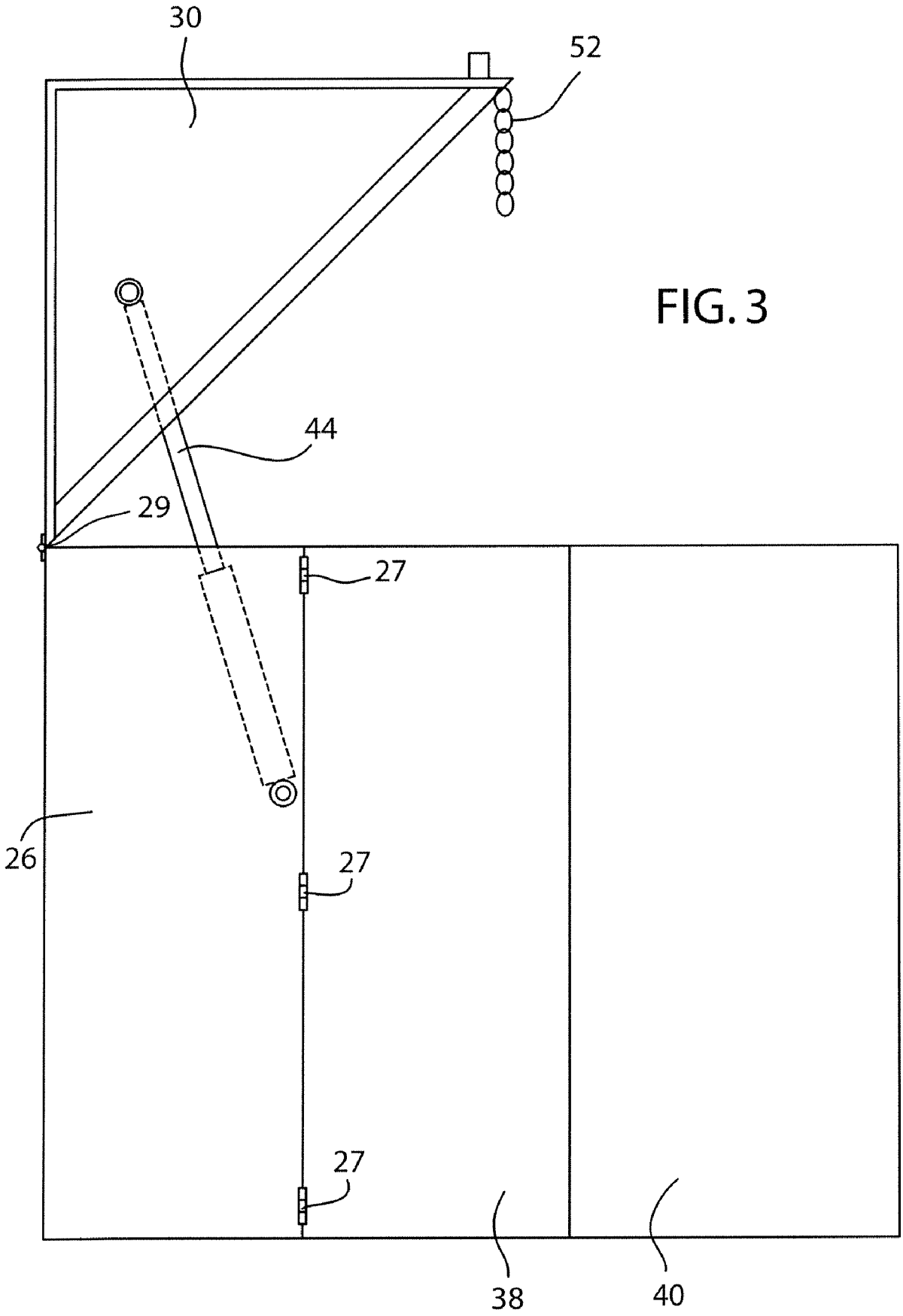
FIG. 3 is a side view of a grille shelter of the present invention in a first position.

A cover such as roof member 30 may be pivotally or hingedly attached to frame assembly 22, adjacent to rear wall 24 with a third hinged attachment 29 as shown in FIGS. 1 and 3. Other suitable attachment methods may be utilized that allow roof member 30 to pivot upwardly and rearwardly above rear wall 24 and side walls 26 and 28. At least one support member 44 may be connected to the housing 32 as shown in FIGS. 1 and 3 to hold roof member 30 in the first/second position. Support member 44 may include a typical hydraulic or pneumatic cylinder similar to those used to hold the hood of a vehicle in an open position. Roof member 30 may alternatively be hingedly attached directly to one of the walls 24, 26 and 28 in an embodiment where no frame assembly 22 is utilized. Likewise, support member 44 may alternatively be connected to first and second side walls 26 and 28 as opposed to frame assembly 22.

Figure 5:
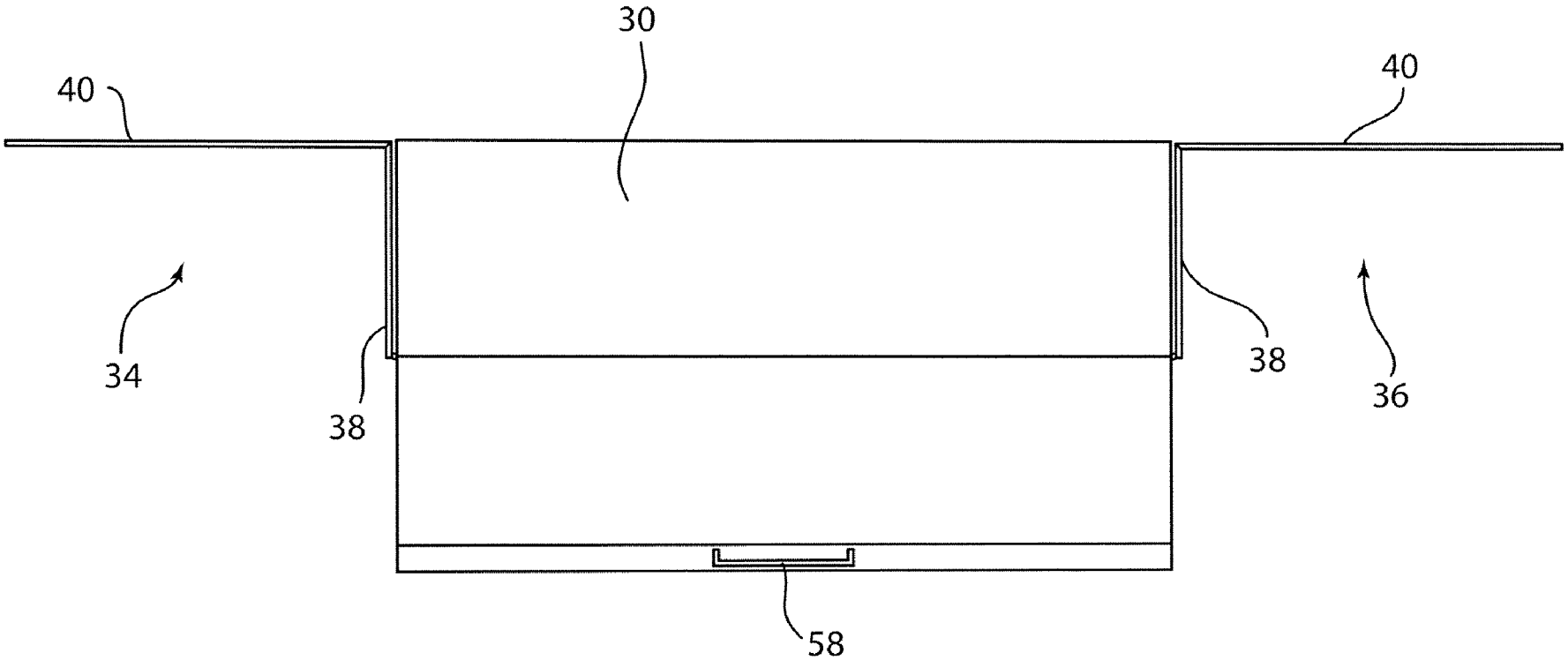
FIG. 5 is a top view of a grille shelter of the present invention in a first position with the sides fully pivoted outward.

To place first and second pivoting panels 34 and 36 in the first position, the user may move first and second pivoting panels 34 and 36 outwardly away from each other to the desired open position as shown in FIGS. 1 and 5. The pivoting relation between first and second pivoting panels 34 and 36 and side walls 26 and 28 allow first and second front pivoting panels 34 and 36 to be easily moved to the first position. The first position may include any of a variety of configurations of first and second pivoting panels 34 and 36 depending on the needs of the user. In one embodiment, pivoting panels 34 and 36 may be moved to a fully opened position to allow the greatest possible access to the grille as shown in FIG. 5. This type of positioning may be desirable to provide additional space for persons working with the grille or standing nearby, particularly in situations such as parties and cookouts. Also, in an embodiment where first and second sections 38 and 40 are pivotally or hingedly attached to one another, pivoting panels 34 and 36 may be positioned in a variety of additional orientations.

With roof member 30 and pivoting panels 34 and 36 moved to the first position, a user may access the barbecue grille contained inside grille shelter 20 and use the grille for cooking. Thus, the user may access the grille for cooking purposes without having to move the grille out of its stored position. The positioning of roof member 30 in the first position may be specifically designed to meet standard clearance requirements to protect grille shelter 20 from damage due to smoke and heat.

Other components may be attached to grille shelter 20 to further add to its functionality and convenience. As shown in FIG. 1, a platform 48 may be connected to frame assembly 22 (or to side walls 26 and 28 and rear wall 24 when no frame assembly is used) to provide a floor for which the grille may be positioned within grille shelter 20. Platform 48 is configured to attach to housing 32 whereby the grille shelter 20 is secured from toppling in adverse weather or during use of the grille as shown in FIG. 4. In addition, grille shelter 20 may include a at least one accessory item mounted to an interior surface of the grille shelter 20, such as one or more hooks 54 mounted on side panel 28 as shown in FIG. 1. Hooks 54 may be used to hang barbecue tools, cooking aprons or other desired tools. One or more shelves 60 may also be mounted on the interior surface of grille shelter 20 as shown in FIG. 1 to provide further storing capabilities within grille shelter 20.

Another feature that may be included on grille shelter 20 is a handle 58 as best shown in FIGS. 1 and 4. Handle 58 may be constructed of a variety of different materials including, but not limited to, wood, metal or plastic, and may be attached to roof member 30 by any of a variety of attachment means known in the art. Handle 58 provides a firm grip location to assist the user with opening and closing roof member 30. A pull cord 52 may also be connected to roof member 30 to further assist the user in moving roof member 30 between the first and second positions as shown in FIG. 3. Pull cord 52 may alternatively attach to handle 58 as shown in FIG. 1. Pull cord 52 may include a section of chain (as shown in the figures), a rope, strap, or other suitable component configured to attach to roof member 30 (or handle 58) to assist an individual who may be unable to reach handle 58 when roof member 30 is in the first position.

While the invention has been described in conjunction with specific embodiments, it is evident that many alternatives, modifications and variations will be apparent to those skilled in the art in light of the foregoing description. Accordingly, the present invention attempts to embrace all such alternatives, modifications and variations that fall within the spirit and scope of the appended claims.

The invention claimed is:

1. A grille shelter comprising:

a housing enclosing a cooking grill comprising a rear wall, a first side wall and a second side wall said first and second side walls each having a rear edge connected to an end of said rear wall and a forward edge, said rear wall and first and second side walls each having a bottom edge supporting said housing on a base surface;

a roof member pivotally connected to a top edge of said housing;

at least one panel pivotally connected to at least one of said side walls;

wherein said at least one pivoting panel is moveable between a first position wherein it is open and a second position wherein it is closed; and wherein said pivoting panel comprises a first section and a second section substantially perpendicular to said first section; and wherein said first section and said second section are pivotally connected.

2. A grille shelter comprising:

a rear wall;

a first and second side walls affixed to opposing ends of said rear wall at right angles thereto said rear wall and first and second side walls supporting said grille shelter up right on a base surface;

a roof member pivotally connected to a too edge of said rear wall;

first and second pivoting panels connected, respectively, to a forward edge of each of said side walls;

wherein each of said pivoting panels is moveable between an open first position and a closed position and said roof member is moveable between an open position and a closed position;

wherein a user may use a grille located in said grille shelter to cook when said roof member and said front wall are in said open first positions;

wherein said grill is sheltered from the elements when said roof and panels are in the closed position; and wherein said first and second pivoting panels each comprise a first section and a second section substantially perpendicular to said first section; and wherein said first second and said second sections are pivotally connected.

* * * * *